US005603452A

United States Patent [19]

Hester

[11] Patent Number: 5,603,452

[45] Date of Patent: Feb. 18, 1997

[54] STATIONARY SPREADER

[76] Inventor: Harvey L. Hester, 1920 W. Hillsdale, Lansing, Mich. 48915

[21] Appl. No.: 521,919

[22] Filed: Aug. 31, 1995

[51] Int. Cl.[6] ..... A01C 17/00

[52] U.S. Cl. ..... 239/1; 239/302; 239/243; 239/263.1; 239/667; 239/673; 239/675; 239/682; 239/683; 239/142

[58] Field of Search ..... 239/1, 661, 667, 239/666, 673, 671, 672, 675, 682, 683, 75, 149, 302, 325, 142, 243, 263.1; 222/54

[56] References Cited

U.S. PATENT DOCUMENTS

| | | | |
|---|---|---|---|
| 1,212,835 | 1/1917 | Steele . | |
| 1,558,282 | 10/1925 | Prang . | |
| 1,629,247 | 5/1927 | Bailey . | |
| 2,336,113 | 12/1943 | McLaughlin | 239/661 X |
| 3,388,869 | 6/1968 | Vissers . | |
| 3,540,655 | 11/1970 | Hinrichs . | |
| 3,559,893 | 2/1971 | Grueben | 239/673 X |
| 3,819,120 | 6/1974 | Walker | 239/661 |
| 3,889,991 | 6/1975 | Hewitt . | |
| 4,166,581 | 9/1979 | Hetrick . | |
| 4,179,073 | 12/1979 | Oosterling et al. . | |
| 4,577,781 | 3/1986 | Braun . | |
| 4,905,912 | 3/1990 | Bruch | 239/661 |
| 5,133,487 | 7/1992 | Russi | 222/54 X |
| 5,340,033 | 6/1995 | Whitell . | |

FOREIGN PATENT DOCUMENTS

| | | | |
|---|---|---|---|
| 0006272 | 6/1979 | European Pat. Off. . | |
| 198562 | 10/1986 | European Pat. Off. | 239/661 |
| 438823 | 7/1991 | European Pat. Off. . | |
| 2648906 | 11/1980 | Germany . | |
| 2914158 | 6/1983 | Germany . | |

*Primary Examiner*—Kevin Weldon
*Attorney, Agent, or Firm*—Ian C. McLeod; Mary M. Moyne

[57] ABSTRACT

A stationary spreader (10) which is activated in response to a signal from a sensor (118) indicating a condition of the adjacent ground surface, is described. The stationary spreader includes a bin (12), a spreader housing (34) and a control box (106) which are removably mounted together. The bin holds the material to be spread and preferably has a stirrer (16) and an auger (18) which both act to move the material out of a dispensing opening (24) in the side (12D) of the bin. The spreader housing is mounted over the dispensing opening and includes a spreader assembly (38). The spreader assembly has a lifting motor (40), a pair of solenoids (62) and a spreader bucket (44). The lifting motor is mounted above and connected to the spreader bucket and acts along with the solenoids to vertically raise or lower the bucket. A spreader compartment (76) is located in the bottom of the bucket and houses the spreaders (86 and 88). The control box houses the control compartments which include motor controllers (112), a timer (114), and a microprocessor (116).

66 Claims, 11 Drawing Sheets

STATIONARY SPREADER

BACKGROUND OF THE INVENTION (1) Field of the Invention

The present invention relates to a stationary spreader which is mounted adjacent a ground surface and which has a dispenser which is preferably, vertically retractable into the stationary spreader when not in use. In particular, the present invention preferably relates to a stationary salt spreader having retractable spreaders which activates when a sensor located in the adjacent road surface detects a temperature below the preset minimum temperature which represents the temperature at which snow and ice will form on the road surface or which is activated recently.

(2) Description of Related Art

The related art shows a variety of spreaders which are intended to be mounted on or connected to a moving vehicle. Illustrative are U.S. Pat. Nos. 1,558,282 to Prang; 1,629,247 to Bailey; 3,388,869 to Vissers; 4,166,581 to Hetrick; and 4,577,781 to Braun.

Prang shows a seed sowing and distributing machine which is entirely supported from a removable end gate of a vehicle. The machine includes an auger provided in the bottom of a hopper adjacent a top opening of a discharge pipe. The auger moves the seeds to the opening of the pipe. The seeds are discharged from the pipe and enter a fan casing under the horizontal shelf through an intake opening under the discharge pipe in the top of the fan casing. The fan casing is provided with a discharge spout and is mounted on springs to allow oscillation in order to distribute over an area. The casing contains a rotary blade fan which rotates in order to eject the seeds from the fan casing. The rotation of the auger and the fan and the oscillation of the fan casing are all provided by movement of the wheels of the vehicle on which the machine is mounted.

Bailey shows a seed or fertilizer distribution machine supported by a bracket on an end gate of a vehicle. The machine has a hopper-like casing with a lower tubular-like part which forms a housing for a revolvable, fluted feed-roller. The feed-roller is connected to rotate with a shaft which passes through the end walls of the housing and which is driven by the ground wheel of the vehicle. An adjustable bucket and a cut-off valve over the feed-roller on the shaft allow for regulating the feed of the material by the roller. A distributing spout is mounted immediately below the housing in order to receive the material discharged through an opening in the housing. The distributing spout and casing are pivotably mounted in order to be able to be moved horizontally by chains connected to the shaft.

Vissers shows an apparatus for spreading powdered or granular materials which is supported in a frame which is provided with two ground wheels. The apparatus includes a hopper mounted on a spreading member. The bottom of the hopper has a disc having passage holes which is mounted over another disc having similarly located passage holes. The spreading member consists of a spout extending outward from a bowl which is secured on a moveable shaft to enable the spout to be moved. The shaft extends through the bowl and through the two discs and into the bottom of the hopper where an upside-down-shaped body is mounted to the end of the shaft. The body rotates to cause the agitation of the material.

Hetrick describes a vehicle mounted device for spreading salt on a road surface. The device has a hopper for holding the salt which is connected to a discharge chamber which discharges the salt into a spreader element for spreading salt on the road surface. A valve mechanism is provided for opening and closing the passage between the discharge chamber and the spreader element. The valve mechanism is controlled by a motor which also controls the agitator in the hopper which loosens the salt for easier discharge.

Braun describes an apparatus which collects liquid from the road surface having a sensor to measure the temperature of the liquid on the road surface in order to regulate a device for spreading salt on the road surface. The apparatus is adapted to be mounted on a moving vehicle.

In addition, U.S. Pat. No. 3,540,655 to Hinrichs shows a stationary pavement deicer mounted to a wall adjacent the pavement. The pavement deicer has a spreader and a control means which activates the spreader when the ambient temperature adjacent the spreader is below a set point where ice will form. The spreader includes a hopper for storing the granular material and a conventional electric motor. The spreader is a conventional spreader similar to those normally used for spreading insecticides, herbicides, seeds and fertilizers. The motor of the spreader is connected to a power source which is controlled by the control means. The control means includes a timer having a constant speed motor which is energized when the thermostat and humidistat are both closed and/or when the output switch is closed. The switch ensures that the motor will rotate through one complete cycle after the thermostat and humidistat sense an ice forming condition. The control means can be used to control more than one spreader.

Also of interest is European Patent No. 438,823 to Zweegers which describes a spreading device for granular or powdered materials intended to be moved along the ground surface by a vehicle. The device includes an elongated hopper having a shaft extending in the longitudinal direction in the funnel-shaped lower part of the hopper. Near the center of the hopper, the shaft extends through a housing. The parts of the shaft on either side of the housing are provided with auger blades which have opposed pitches such as to move the granular material toward the housing during rotation of the shaft. A wheel provided with blades is located on the shaft in the housing. The blades of the wheel project downward from the bottom side of the hopper and the lower part of the blades cooperate with the upper part of an endless belt. Behind a rear guide roller of the belt is a gutter shaped spreading means having two throwing arms which pivot horizontally on vertical pivot pins. The arms pivot together in response to the movement of the shaft by means of rods connected to a ring mounted on the shaft.

Also of some interest are U.S. Pat. Nos. 1,212,835 to Steele; 3,889,991 to Hewitt; 4,179,073 to Oosterling et al; 5,340,033 to Whitell; German Patent No. 2,648,906 and German Patent Application No. 2,914,158 both to Braun and European Published Application 0 006 272 to Della Faille d'Huysse.

There remains a need for a stationary spreader having a retractable dispenser which is mounted adjacent the ground surface and which is preferably activated by a temperature sensor which detects the ambient temperature of the surrounding ground surface.

OBJECTS

Therefore, it is an object of the present invention to provide a stationary spreader which has a retractable dispenser when not in use. Further, it is an object of the present invention to provide a stationary spreader which automatically activates in response to a preset condition. Still further, it is an object of the present invention to provide a stationary spreader which is activated from a remote location. Further still, it is an object of the present invention to provide a stationary spreader which is permanently mounted adjacent to a road surface and which spreads salt on the road surface to melt snow and ice. Further, it is an object of the present invention to provide a stationary spreader which is automatically activated when the temperature of the adjacent road surface falls below a preset minimum temperature. Still further, it is an object of the present invention to provide a stationary spreader which automatically deactivates after a preset time interval. Still further, it is an object of the present invention to provide a stationary spreader which has retractable spreaders which are moved upward inside the spreader when deactivated. Further still, it is an object of the present invention to provide a stationary spreader which is able to treat a large area. Further, it is an object of the present invention to provide a stationary spreader which is efficient to operate and which requires minimal maintenance. These and other objects will become increasingly apparent by reference to the following description and to the drawings.

DETAILED DESCRIPTION OF THE PREFERRED EMBODIMENTS

Figure 1:
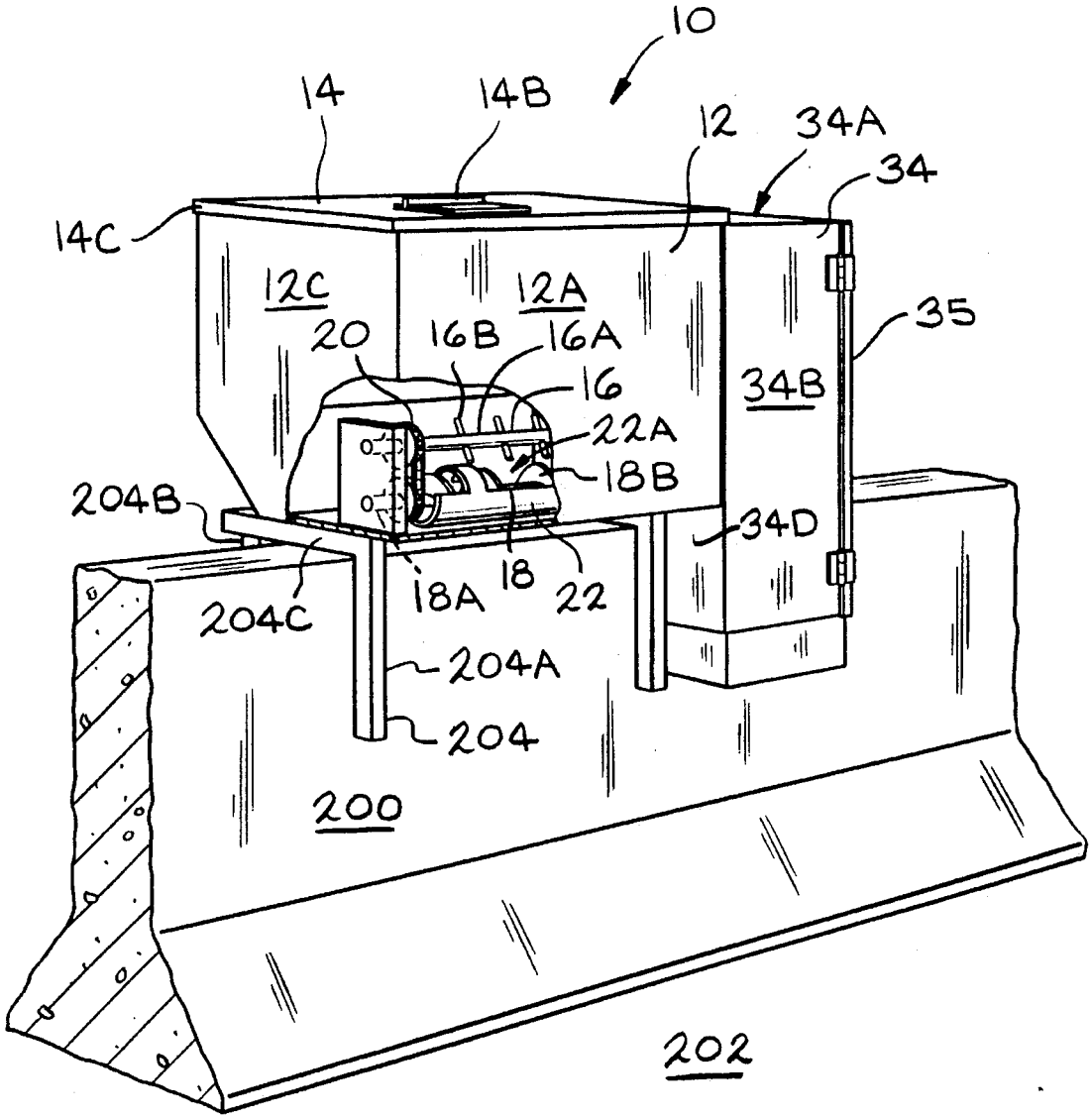
FIG. 1 is a perspective view of the stationary spreader 10 mounted on the barrier 200 having a cut away section showing the stirrer 16 and the auger 18 inside the bin 12.

The present invention relates to a stationary spreader apparatus to be located adjacent a ground surface for spreading a material on the ground surface to treat the ground surface, which comprises: a storage container having at least one opening for dispensing the material; a vertically movable spreader means having an inlet connected to the opening in the storage container and having an outlet for spreading the material including; a movement means connected to the spreader means for moving the spreader means in a vertical direction toward and away from the ground surface; a dispensing means mounted between the inlet and the outlet of the spreader means for moving the material through the outlet; and a control means connected to the movement means and the dispensing means for activating the movement means to move the spreader means in a vertical direction toward the ground surface and for activating the dispensing means to dispense the material on the ground surface.

Further, the present invention relates to a stationary salt spreader apparatus to be located adjacent a road surface for spreading salt on the road surface to melt ice and snow on the road surface, which comprises: a storage container having at least one opening for dispensing the salt; a vertically movable spreader means having an inlet connected to the opening in the storage container and having an outlet for spreading the salt including; a movement means connected to the spreader means for moving the spreader means in a vertical direction toward and away from the road surface; an acceleration means mounted between the inlet and the outlet of the spreader means for moving the salt through the outlet; a motor means connected to the acceleration means for moving the acceleration means; and a control means connected to the movement means and the motor means for activating the movement means to move the spreader means in a vertical direction toward the road surface and for activating the motor means to move the acceleration means to dispense the salt on the road surface.

Still further, the present invention relates to a stationary spreader apparatus to be located adjacent a road surface for spreading a material on the road surface to heat the road surface, which comprises: a storage container having at least one opening for dispensing the material; a vertically movable spreader means having an inlet connected to the opening in the storage container and having an outlet for spreading the material including; a movement means connected to the spreader means for moving the spreader means in a vertical direction toward and away from the road surface; a dispensing means mounted between the inlet and the outlet of the spreader means for moving the material through the outlet; and a control means connected to the movement means for activating the movement means to move the spreader means in a vertical direction toward the road surface and for activating the dispensing means to dispense the material on the road surface.

Further, the present invention relates to a method for melting ice and snow accumulated on a road surface, with a stationary spreader apparatus adjacent the road surface for spreading salt on the road surface to melt ice and snow on the road surface, which comprises: a storage container having at least one opening for dispensing the salt; a vertically movable spreader means having an inlet connected to the opening in the storage container and having an outlet for spreading the salt including; a first motor means connected to the spreader means for moving the spreader means in a vertical direction toward and away from the road surface; and an acceleration means mounted between the inlet and the outlet of the spreader means for spreading the salt through the outlet; a second motor means connected to the acceleration means for moving the acceleration means; and a control means connected to the first and second motor means for activating the first motor means to move the spreader means in a vertical direction toward the road surface and for activating the second motor to move the acceleration means to dispense the salt on the road surface; filling the storage container with granulated salt; and dispensing the granulated salt from the spreader means by activating the movement means and the motor means in response to the sensing of an ambient temperature below a preset minimum temperature by the control means so that the salt spreader apparatus spreads salt on the road surface to melt the ice and snow.

The stationary spreader preferably includes a stirring means mounted in the storage container for loosening the material for easier removal. The storage container preferably also has an auger means which is mounted in a conduit and which moves the material along the conduit and out through the opening of the storage container. The stirring means and the auger means are connected together and rotated by an auger motor mounted outside of the storage container. A supply conduit extends between the opening of the storage container and the inlet of the spreader means to provide a passageway from the storage container to the spreader means. The supply conduit has an expandable portion to allow the spreader means to be vertically movable. The movement means for the spreader means includes solenoids and a lifting motor with a threaded shaft. The solenoids are connected to a threaded holder which contacts the rotating threaded shaft of the lifting motor to lift the spreader means upward when the solenoid is deactivated. The spreader can be filled with any type of soiled or liquid material to be spread on the adjacent ground surface. When used for spreading a liquid material, the spreader is provided with a pump to move the liquid material to the dispensing means which are preferably nozzles. When used with solid material, the spreader is provided with a spreader means. The spreader means includes two spreaders having two acceleration means with two motor means which are able to be moved upward into a spreader housing. The control means includes a sensor, a timer and controls for activating and deactivating the motors and for energizing or de-energizing the solenoids. The stationary spreader apparatus is preferably mounted on a barrier adjacent a road surface and is preferably activated when the sensor detects a preset minimum temperature which is between about −30° and 34° F. The timer means preferably deactivates the stationary spreader apparatus after between about 0.01 to 5 minutes of operation.

Figure 2:
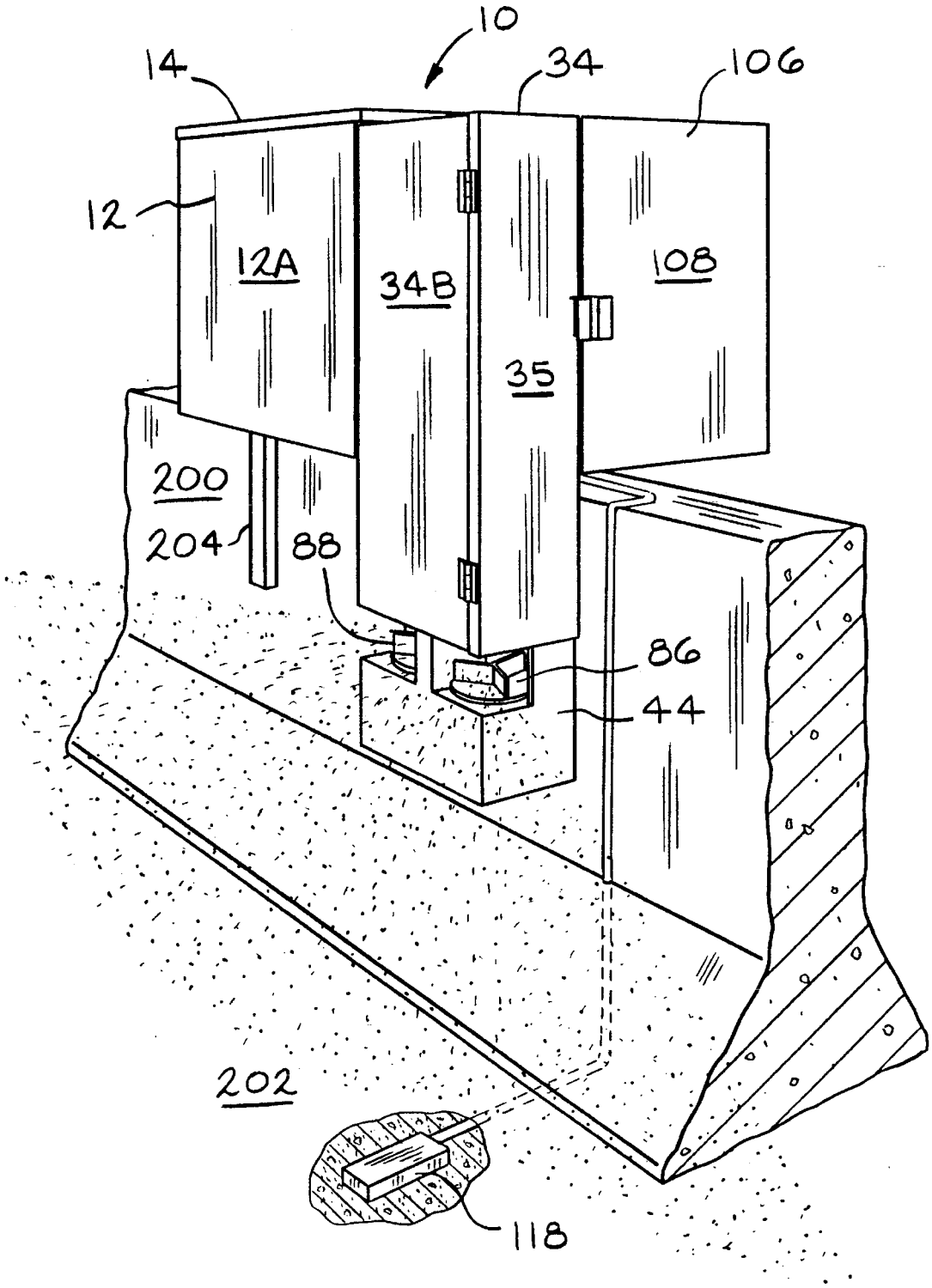
FIG. 2 is a perspective view of the stationary spreader 10 with a cut away section showing the sensor 118 mounted in the ground surface and showing the spreader bucket 44 in the lowered position with the spreaders 86 and 88 activated.
Figure 3:
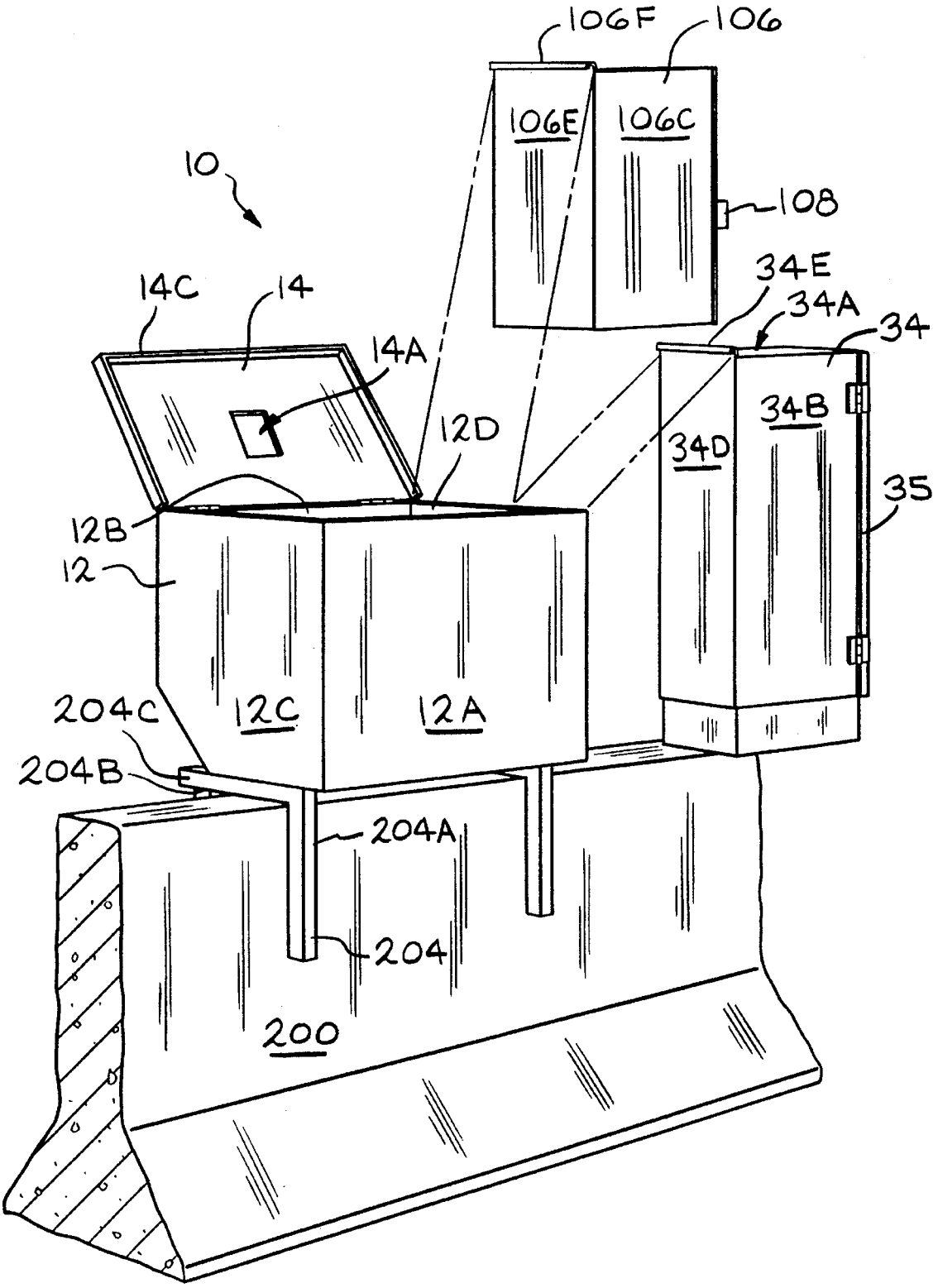
FIG. 3 is an exploded view of the stationary spreader 10 showing the interconnection of the bin 12, the spreader housing 34 and the control box 106 of the stationary spreader 10.
Figure 9:
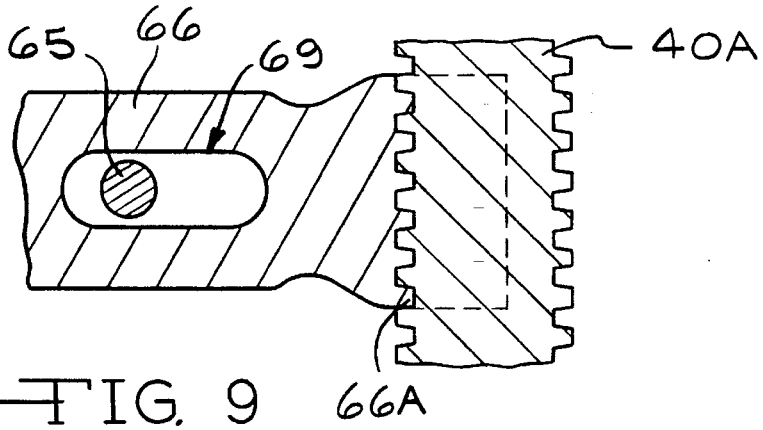
FIG. 9 is a partial side cross-sectional view of the threaded holder 66A in the lifting position engaging the threaded shaft 40A.
Figure 10:
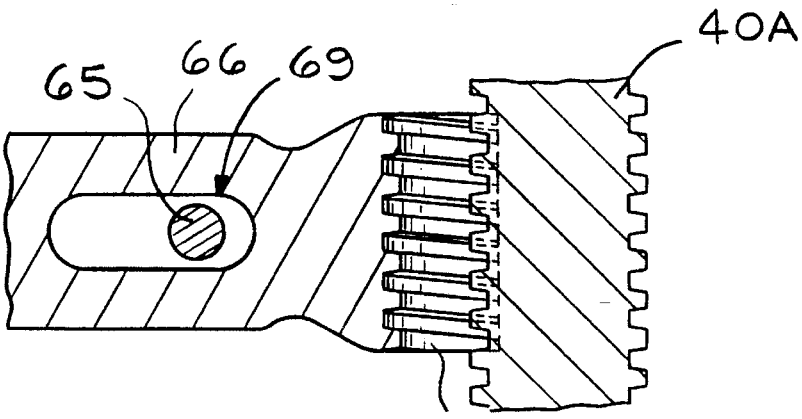
FIG. 10 is a partial side cross-sectional view of the threaded holder 66A disengaged from the threaded shaft 40A.
Figure 11:
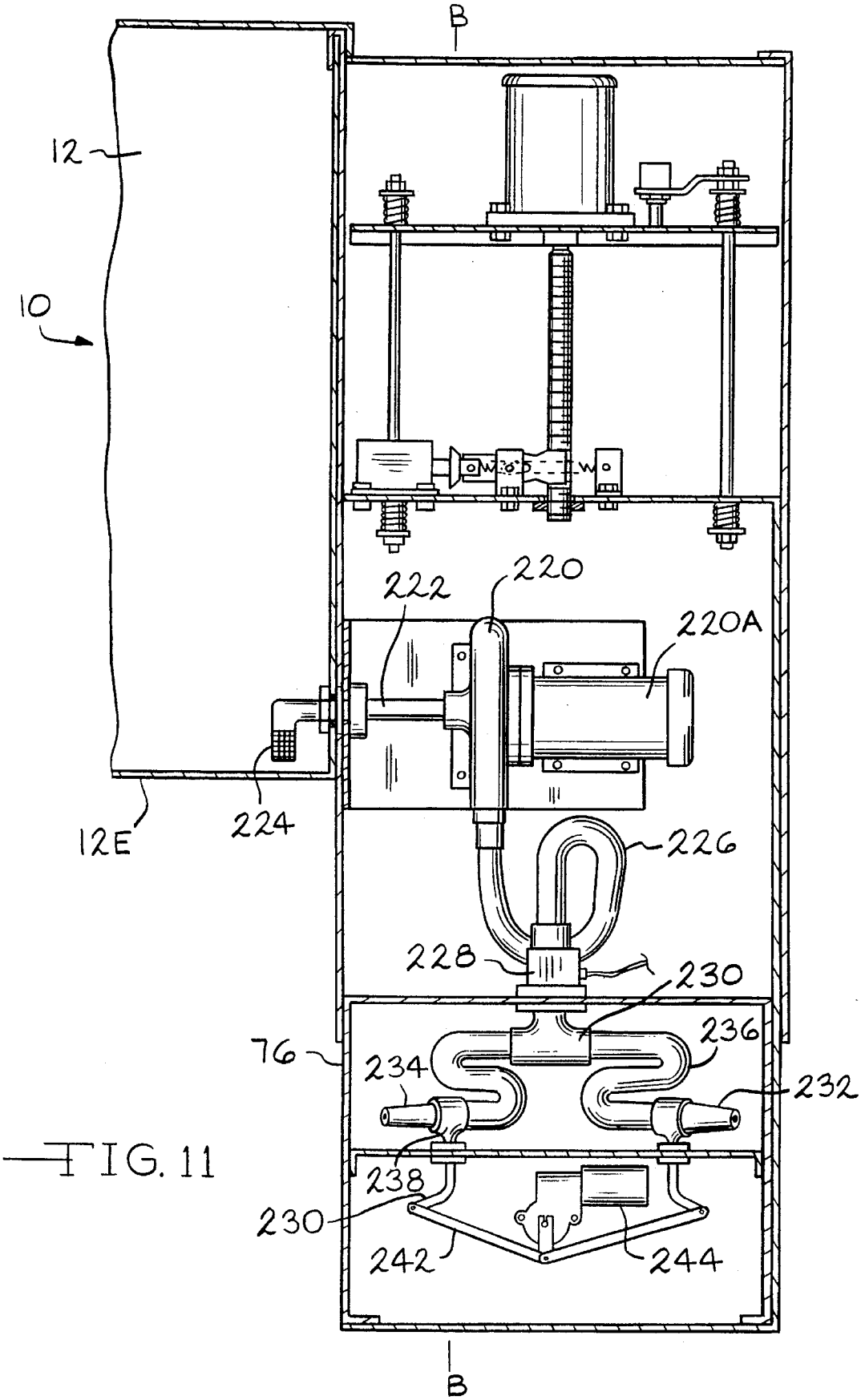
FIG. 11 is a partial front cross-sectional view of the alternate embodiment of the stationary spreader 10 showing the nozzles 232 and 234 and the oscillating motor 244.

FIGS. 1 to 10 show the preferred embodiment of the stationary spreader 10 of the present invention. FIG. 11 shows an alternate embodiment of the stationary spreader 10 of the present invention. The stationary spreader 10 includes a bin 12 or hopper, a spreader housing 34 and a control box 106. The bin 12, spreader housing 34 and control box 106 are preferably separable units which allow for easy disassembly and easy replacement of any of the units (FIG. 3). The removability of the spreader housing 34 and the control box 106 from the bin 12 allows for easy replacement and repair of the stationary spreader 10 without having to remove the entire unit from the stationary mounting position. Preferably, the spreader 10 is provided with a support frame 204. The support frame 204 has front legs 204A and back legs 204B (one shown) with a pair of rails 204C extending therebetween. In the preferred embodiment, as shown in FIGS. 1 to 3, the spreader 10 is mounted on a barrier 200. The support frame 204 is mounted on the top of the barrier 200 such that the rails 204C extend over the top of the barrier 200 and the front and back legs 204A and 204B extend downward adjacent the front and back, respectively of the barrier 200. The bin 12 of the stationary spreader 10 is secured onto the rails 204C of the support frame 204 such that the bin 12 strattles the barrier 200 with the spreader housing 34 adjacent the front of the barrier 200 facing the surface 202 to be treated and the control box 106 adjacent the back of the barrier 200. The support frame 204 is preferably permanently mounted on the barrier 200 and the bin 12 is preferably permanently mounted on the support frame 204. In an alternate embodiment, the bin 12 is mounted on sliding rails having rollers (not shown) which engage the rails 204C of the support frame 204. The sliding rails enable the bin 12 with the spreader housing 34 (to be described in detail hereinafter) to be moved outward away from the barrier 200 and toward the road surface 202 when in use and to be retracted over the top of the barrier 200 when not in use. Thus, the spreader 10 is able to be mounted farther away from the road surface 202 and still be able to provide full coverage of the road surface 202 when in use. In the preferred embodiment, the stationary spreader 10 is mounted on the barrier 200 adjacent a road surface 202 (FIG. 2). The stationary spreader 10 however, could also be free standing.

The bin 12 has an essentially rectangular shape with a front wall 12A, a back wall 12B, two sidewalls 12C and 12D and a bottom wall 12E. The open top of the bin 12 is preferably provided with a lid 14 which is pivotably hinged to the back wall 12B to allow for easy filling of the bin 12. Preferably, the lid 14 of the bin 12 has a flange 14C around the outer circumference which extends over the front and sidewalls 12C and 12D of the bin 12 and which also extends over the lips 34E and 106F of the spreader housing 34 and the control box 106 (to be described in detail hereinafter) in order to securely hold the spreader housing 34 and control box 106 on the bin 12. The lid 14 preferably locks such as to prevent the unauthorized removal of the spreader housing 34 or the control box 106. The lid 14 is preferably provided with an opening 14A covered by a sliding door 14B which allows for filling the bin 12 without opening the lid 14. The bottom of the back wall 12B of the bin 12 is preferably angled inward toward the front wall 12A. The angling of the back wall 12B helps to move the material toward the auger 18 and the dispensing conduit 22 (to be described in detail hereinafter) for more efficient and complete removal of the material from the bin 12. In the preferred embodiment, the bin 12 is 4 feet (122 cm) wide and 2 feet 6 inches (76 cm) tall with a depth of 2 feet 8 inches (81 cm).

As shown in FIG. 1, a stirrer 16 and an auger 18 are preferably mounted in the bottom of the bin 12 and extend between the sidewalls 12C and 12D of the bin 12 such as to be parallel with the front and back walls 12A and 12B of the bin 12. The stirrer 16 has a central shaft 16A with splines 16B spaced apart along the shaft 16A. The auger 18 also has a central shaft 18A around which is mounted a spiral blade 18B. The stirrer 16 is preferably mounted above the auger 18 and acts to loosen the material during rotation to allow for easier flow of the material out of the dispensing opening 24 of the bin 12. The shafts 16A and 18A of the stirrer 16 and auger 18 are preferably connected together at one end by a drive belt 20 or chain. The other end of the shaft 16A of the stirrer 16 is preferably mounted in a block adjacent one of the sidewalls 12C of the bin 12 which allows for free rotation of the stirrer 16. The other end of the shaft 18A of the auger 18 is connected to an auger motor 30 which rotates the auger 18 and consequently, the stirrer 16. The stirrer 16 and the auger 18 are preferably constructed of steel although any other suitable material could be used. The auger motor 30 is preferably similar to the Motor 40 sold by Kendall Electric located in Lansing, Mich. The auger 18 is mounted in a dispensing conduit 22 which extends from the one sidewall 12C of the bin 12 and through a dispensing opening 24 in the other sidewall 12D of the bin 12 into the spreader housing 34. The dispensing conduit 22 is preferably cylindrical with a semi-circular cross-section having an opening 22A along the top. The rotating auger 18 moves the material along the dispensing conduit 22 and out of the dispensing opening 24 in the sidewall 12D of the bin 12. In an alternate embodiment, such as when the bin 12 is filled with a liquid material, such as a liquid salt solution or a liquid fertilizer solution, a first pump 220 having a motor 220A is mounted in the spreader housing 34 adjacent the dispensing opening 24 of the bin 12 (FIG. 11). A suction conduit 222 is preferably connected at one end to the pump 220 and extends into the bin 12 through the dispensing opening 24. The end of the conduit 222 opposite the pump 220 is preferably provided with a screen filter 224 to prevent any large foreign objects from entering the pump 220. In the alternate embodiment, the bin 12 is sealed to prevent leakage of the material. In addition, the stirrer 16 and auger 18 do not need to be provided to agitate the material.

Figure 4:
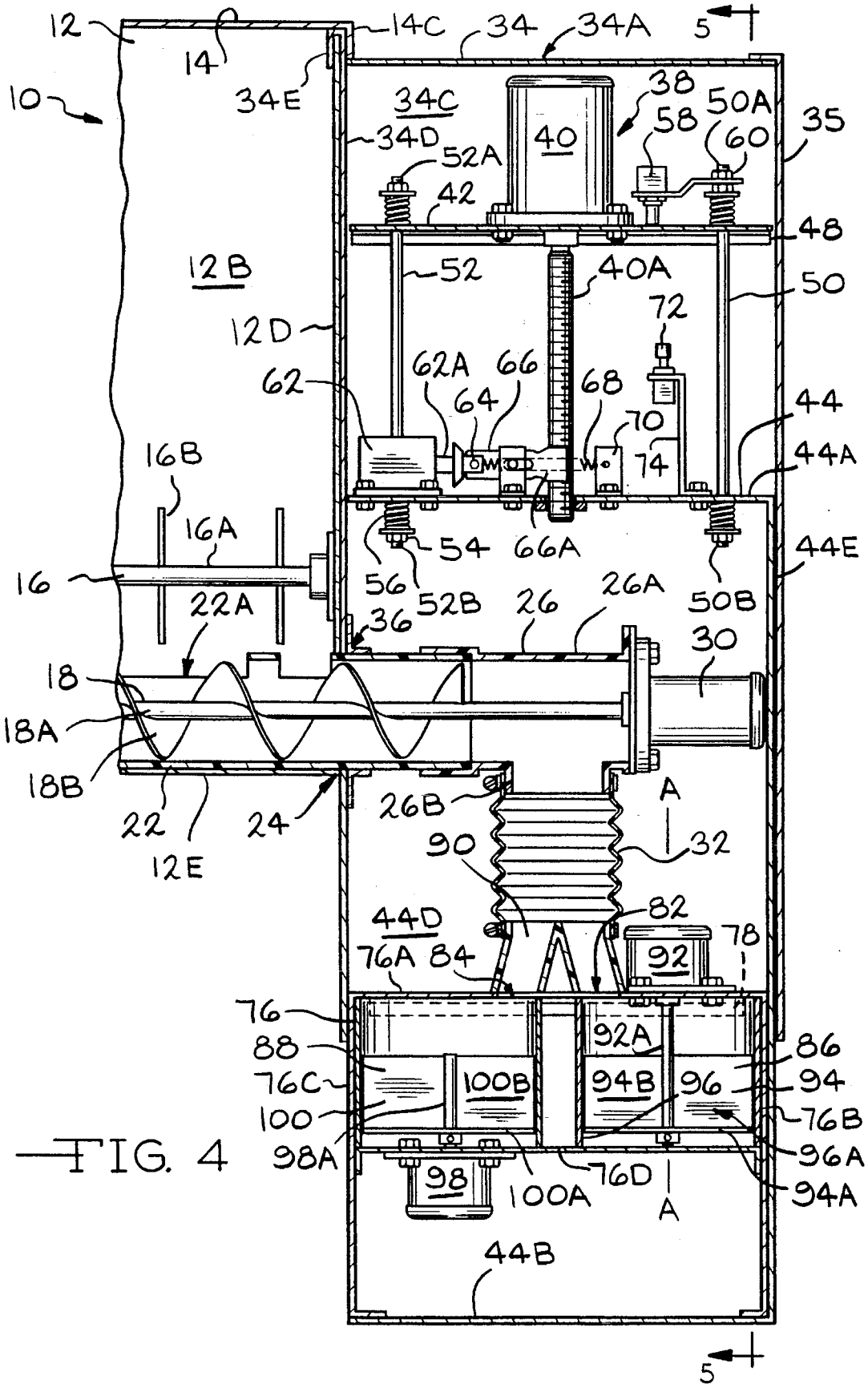
FIG. 4 is a partial front cross-sectional view of the stationary spreader 10 with the spreader bucket 44 in the lowered, activated position showing the lifting motor 40, the solenoids 62, the dispensing conduit 22, the expandable dispensing conduit 32 and the right and left spreaders 86 and 88 with the right and left impeller motors 92 and 98.

A T-connector 26 is mounted on the end of the dispensing conduit 22 in the spreader housing 34. The top arm 26A of the T-connector 26 preferably has one end connected to the dispensing conduit 22. The other end is provided with a motor mount 28 for mounting the auger motor 30 (FIG. 4). The perpendicular arm 26B of the T-connector 26 is connected to an expandable dispensing conduit 32. The dispensing conduit 22, the T-connector 26 and the expandable dispensing conduit 32 are preferably constructed of plastic. In the alternate embodiment, a flexible line 226 is connected at one end to the pump 220. The other end of the flexible line 226 is connected to an electronic valve 228 mounted in the top wall 76A of the spreader compartment 76 which prevents the material from entering the nozzles 232 and 234 when the spreader 10 is deactivated. The other end of the electronic valve 228 is connected to a split tee 230 which splits the material into the two nozzles 232 and 234.

The spreader housing 34 preferably has an essentially rectangular shape with a top wall 34A, a front wall 34B and a back wall 34C with a sidewall 34D therebetween. The side of the spreader housing 34 opposite the sidewall 34D is provided with a hinged door 35 which allows for easy access to the inside of the spreader housing 34 for easy repair or replacement of the spreader assembly 38 (to be described in detail hereinafter). The spreader housing 34 is mounted on the sidewall 12D of the bin 12 adjacent the front wall 12A of the bin 12. The sidewall 34D of the spreader housing 34 is adjacent the sidewall 12D of the bin 12 and has an opening 36 to allow the dispensing conduit 22 to extend into the spreader housing 34. The sidewall 34D extends above the top wall 34A of the spreader housing 34 and has a lip 34E which allows for mounting the spreader housing 34 on the sidewall 12D of the bin 12 (FIG. 3).

A spreader assembly 38 is mounted within the spreader housing 34 and includes a lifting motor 40, solenoids 62, and spreaders 86 and 88 having impellers 94 and 100 and impeller motors 92 and 98 (FIGS. 4 to 7). The lifting motor 40 preferably has a threaded shaft 40A and is mounted on a plate 42 adjacent the top wall 34A of the spreader housing 34. The plate 42 is mounted into the spreader housing 34 on rails 48 which extend along the front and back walls 34B and 34C of the housing 34. The rails 48 prevent the plate 42 from moving downward and allow for easier removal and insertion of the plate 42 and lifting motor 40 for repair or replacement of the motor 40. The lifting motor 40 is mounted on the plate 42 such that the motor 40 extends above the plate 42 and the threaded shaft 40A extends downward through a hole (not shown) in the plate 42. The plate 42 with the lifting motor 40 is spaced above and slidably connected to a vertically movable, inner spreader bucket 44. The spreader bucket 44 has a top wall 44A, a bottom wall 44B, a front wall 44C, a back wall 44D and one sidewall 44E and is mounted in the spreader housing 34 such that the side of the bucket 44 adjacent the bin 12 is open. The plate 42 is preferably connected to the top wall 44A of the bucket 44 by two connector rods 50 and 52 mounted at opposite, diagram corners of the plate 42 and the bucket 44. The first ends 50A and 52A of the rods 50 and 52 extend through holes (not shown) in the plate 42 and the second ends 50B and 52B of the rods 50 and 52 extend through the top wall 44A of the bucket 44. The ends 50A, 50B, 52A and 52B of the rods 50 and 52 are preferably threaded and provided with attachment nuts 54 to hold the rods 50 and 52 in the plate 42 and the bucket 44. In the preferred embodiment, springs 56 are mounted on the rods 50 and 52 adjacent the ends 50A, 50B, 52A and 52B of the rods 50 and 52 between the nuts 54 and the plate 42 and the nuts 54 and the top wall 44A of the bucket 44. The springs 56 cushion the fall of the bucket 44 when the stationary spreader 10 is activated. The first end 50A of one of the rods 50 adjacent the plate 42 is provided with a first switch 58. The first switch 58 is mounted onto the end 50A of the rod 50 above the attachment nut 54 by a second nut 60. The first switch 58 is mounted upside down such that when the stationary spreader 10 is activated and the bucket 44 drops and reaches the lowermost position, the first switch 58 comes in contact with the plate 42 which activates the auger motor 30 to rotate the auger 18 and the stirrer 16 or alternatively, the pump 226. The lifting motor 40 is preferably similar to the Motor 30 sold by Kendall Electric located in Lansing, Mich.

Figure 8:
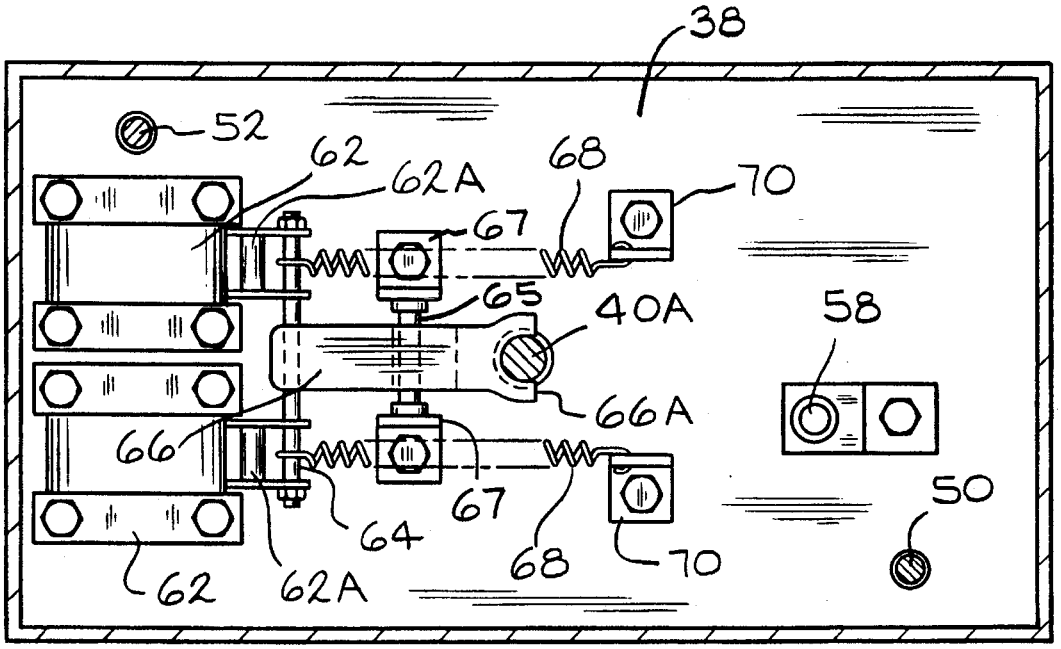
FIG. 8 is a top partial cross-sectional view of the spreader assembly 38 below the lifting motor 40 showing the solenoids 62 in the de-energized position with the threaded holder 66A engaging the threaded shaft 40A of the lifting motor 40.

A pair of solenoids 62 are mounted on the top wall 44A of the bucket 44 on the side adjacent the plate 42. The arms 62A of the solenoids 62 are connected together by a horizontal first pin 64 which extends perpendicular to the arms 62A. A shaft 66 is movably mounted at one end on the pin 64. The first pin 64 extends through a hole (not shown) in the end of the shaft 66. The diameter of the hole is slightly larger than the diameter of the pin 64 such that the shaft 66 is able to rotate on the pin 64. A horizontal second pin 65 is supported by mounts 67 spaced in front of the solenoids 62 on either side of the shaft 66. The second pin 65 extends through a center slot 69 in the shaft 66. The slot 69 allows the shaft 66 to be moved toward and away from the threaded shaft 40A of the lifting motor 40. The width of the slot 69 is preferably slightly larger than the diameter of the shaft 66 such that the shaft 66 is able to move vertically in order to be vertically positioned around the threaded shaft 40A of the lifting motor 40. However, preferably the width of the slot 69 is such as to prevent the shaft 66 from moving too far up or down vertically such as to ensure that the holder 66A will contact the threaded shaft 40A in an essentially perpendicular position. The shaft 66 is mounted such that the shaft 66 extends essentially perpendicular to the threaded shaft 40A of the lifting motor 40 (FIG. 8). The end of the shaft 66 adjacent the threaded shaft 40A is provided with a threaded holder 66A. In the energized mode, the shaft 66 and holder 66A are pulled back such that the holder 66A is spaced apart from the threaded shaft 40A of the lifting motor 40 (FIG. 10). In the de-energized mode, the holder 66A is adjacent and around the threaded shaft 40A such that the threads of the holder 66A engage the threads of the threaded shaft 40A (FIG. 9). The vertically movable mounting of the shaft 66 on the pins 64 and 65 allow the threaded holder 66A to be vertically positionable such that when the solenoids 62 are first de-energized, the threaded holder 66A is only loosely in contact with the threaded shaft 40A in order to allow the threads of the holder 66A to match and engage the threads of the threaded shaft 40A at which time the holder 66A settles into the horizontal, level, perpendicular position around the shaft 40A. In the preferred embodiment, a pair of springs 68 are mounted on either side of the shaft 66 and threaded holder 66A and extend between the first pin 64 and holders 70 located on either side of the threaded shaft 40A of the lifting motor 40 (FIG. 8). The springs 68 act to bias the threaded holder 66A into position around the threaded shaft 40A when the solenoids 62 are de-energized. The solenoids 62 are preferably similar to the those sold by Kendall Electric located in Lansing, Mich.

A second switch 72 is mounted on the top wall 44A of the bucket 44 on the same side as the solenoids 62. The second switch 72 is mounted on an extension bracket 74 which positions the switch 72 above the top of the bucket 44 and above the solenoids 62. The switch 72 is positioned such that when the bucket 44 is lifted upward to its uppermost, raised position, the switch 72 comes in contact with the plate 42 which deactivates the lifting motor 40 which stops the upward movement of the bucket 44.

The bottom of the bucket 44 extends below the sidewall 34D of the spreader housing 34 and is provided with a spreader compartment 76. The spreader compartment 76 has essentially a rectangular shape with a top wall 76A with sidewalls 76B and 76C extending therefrom and an inner middle shelf 76D extending between the sidewalls 76B and 76C parallel to the top wall 76A. The compartment 76 slides into the bottom of the bucket 44 on a pair of rails 78. The rails 78 are preferably spaced upward, away from the bottom wall 44B of the bucket 44 and extend along the front and back walls 44C and 44D of the bucket 44. The sidewalls 76B and 76C are preferably provided with notches 79 at each corner adjacent the top wall 76A so as to allow the rails 78 to slide into the compartment 76 adjacent the top wall 76A. The compartment 76 is mounted in the bucket 44 such that the sidewall 76C of the compartment 76 is adjacent the sidewall 44E of the bucket 44.

The top wall 76A of the compartment 76 is provided with inlets 82 and 84 which extend into spreaders 86 and 88. In the preferred embodiment, there is a right and left spreader 86 and 88 having right and left inlets 82 and 84, respectively. A spliter 90 is connected at one end to the end of the expandable dispensing conduit 32 opposite the T-connector 26 and at the other end to each of the inlets 82 and 84 of the spreaders 86 and 88. The spliter 90 acts to divide the material exiting the dispensing conduit 32 between the two spreaders 86 and 88. The spreaders 86 and 88 are mounted side-by-side and spaced apart in the spreader compartment 76. The spreaders 86 and 88 are preferably mounted in the spreader compartment 76 between the top wall 76A and the inner middle shelf 76D. The right spreader 86 has an impeller motor 92 on which is mounted an impeller 94. The impeller motor 92 is preferably mounted on the inner middle shelf 76D of the compartment 76 such that the shaft 92A of the motor 92 extends upward through a hole (not shown) in the middle shelf 76D. The impeller 94 is mounted on the shaft 92A between the top wall 76A and the middle shelf 76D of the compartment 76 such that the impeller 94 rotates around the vertical axis A—A of the spreader 86. The impeller 94 preferably has a circular base 94A with fins 94B extending upward from the base 94A on the side opposite the middle shelf 76D. The fins 94B preferably intersect in the center of the base 94A at a point aligned with the shaft 92A of the impeller motor 92. In the preferred embodiment, there are three fins 94B on the base 94A spaced approximately about 120° apart. The spreader 86 is provided with a deflector 96 which extends upward from the inner middle shelf 76D toward the top of the compartment 76. The deflector 96 is preferably cylindrical in shape with an opening 96A adjacent the front of the compartment 76. The diameter of the deflector 96 is preferably slightly larger than the diameter of the impeller 94 such that the impeller 94 is able to rotate within the deflector 96 without contacting the deflector 96. However, the deflector 96 should be of such a size as to prevent the material being spread from falling off the impeller 94 and between the impeller 94 and the deflector 96. The deflector 96 prevents the impeller 94 from throwing the material toward the inside of the compartment 76. In the preferred embodiment, the left spreader 88 is similar to the right spreader 84 except that the impeller motor 98 of the left spreader 88 is mounted upside down as compared to the impeller motor 92 of the right spreader 86. Thus, the left impeller motor 98 is mounted in the top wall 76A of the compartment 76 such that the shaft 98A of the impeller motor 98 extends downward through a hole (not shown) in the top wall 76A of the compartment 76 and into the inside of the spreader compartment 76. The impeller 100 is mounted on the shaft 98A of the left impeller motor 98 such that the fins 100B of the impeller 100 extend upward from the base 100A toward the top wall 76A of the compartment 76. Thus, the impellers 94 and 100 are positioned similarly however due to the opposite positioning of the impeller motors 92 and 98, the impellers 94 and 100 rotate in opposite directions. The opposite rotation of the impellers 94 and 100 allows the spreaders 86 and 88 to cover a larger area with less overlap. In the preferred embodiment, the impellers 94 and 100 have a diameter of 7 inches. The impeller motors 92 and 98 are preferably a 1/30 hp motor such as that sold by Grainger located in Lansing, Mich.

In the alternate embodiment, the material is spread by nozzles 232 and 234 which spray the material onto the surface 202 to be treated (FIG. 11). The nozzles 232 and 234 are connected by flexible hoses 236 which are connected to opposed ends of the split tee 220. Preferably, there are two nozzles 232 and 234 mounted side-by-side and extend perpendicular to the axis B—B of the spreader compartment 76. In the alternate embodiment, the nozzles 232 and 234 are mounted onto rotatable brackets 238. The rotatable brackets 238 are connected to arms 240 which are connected to bars 242 connected to an oscillator motor 244. The nozzles 232 and 234 are preferably oscillated in a side-to-side motion to increase the area of coverage. The nozzles 232 and 234 preferably rotate between 0° and 180° such as to provide complete coverage of the surface 202 in front of the stationary spreader 10. Preferably, the nozzles 232 and 234 do not rotate so as to spray the material within the spreader compartment 76. The spreader compartment 76 is provided with a splash guard (not shown) to prevent the material from entering the spreader compartment 76. Preferably, the pump 220 provides the material to the nozzles 232 and 234 under pressure which enables the nozzles 232 and 234 to spread the material a farther distance from the stationary spreader 10.

The front wall 44C and the sidewall 44E of the bucket 44 and the sidewalls 76B and 76C of the spreader compartment 76 are provided with openings 102 and 104 adjacent each of the spreaders 86 and 88. Preferably, the openings 102 and 104 are rectangular and extend from the middle of the front wall 44C of the bucket 44 and around the corner to the sidewalls 44E and 76B and 76C of the bucket 44 and the compartment 76 and extend from the inner middle shelf 76 to the top wall 76A of the compartment 76. The bottom half of the compartment 76 is covered with the front wall 44C of the bucket 44 which extends below the front wall 34B of the spreader housing 34 even when the spreaders 86 and 88 are in the raised, inactive position. The front wall 44C of the bucket 44 prevents tampering with the spreaders 86 and 88 and prevents snow, dirt and other foreign particles from entering the spreader housing 34.

Figure 5:
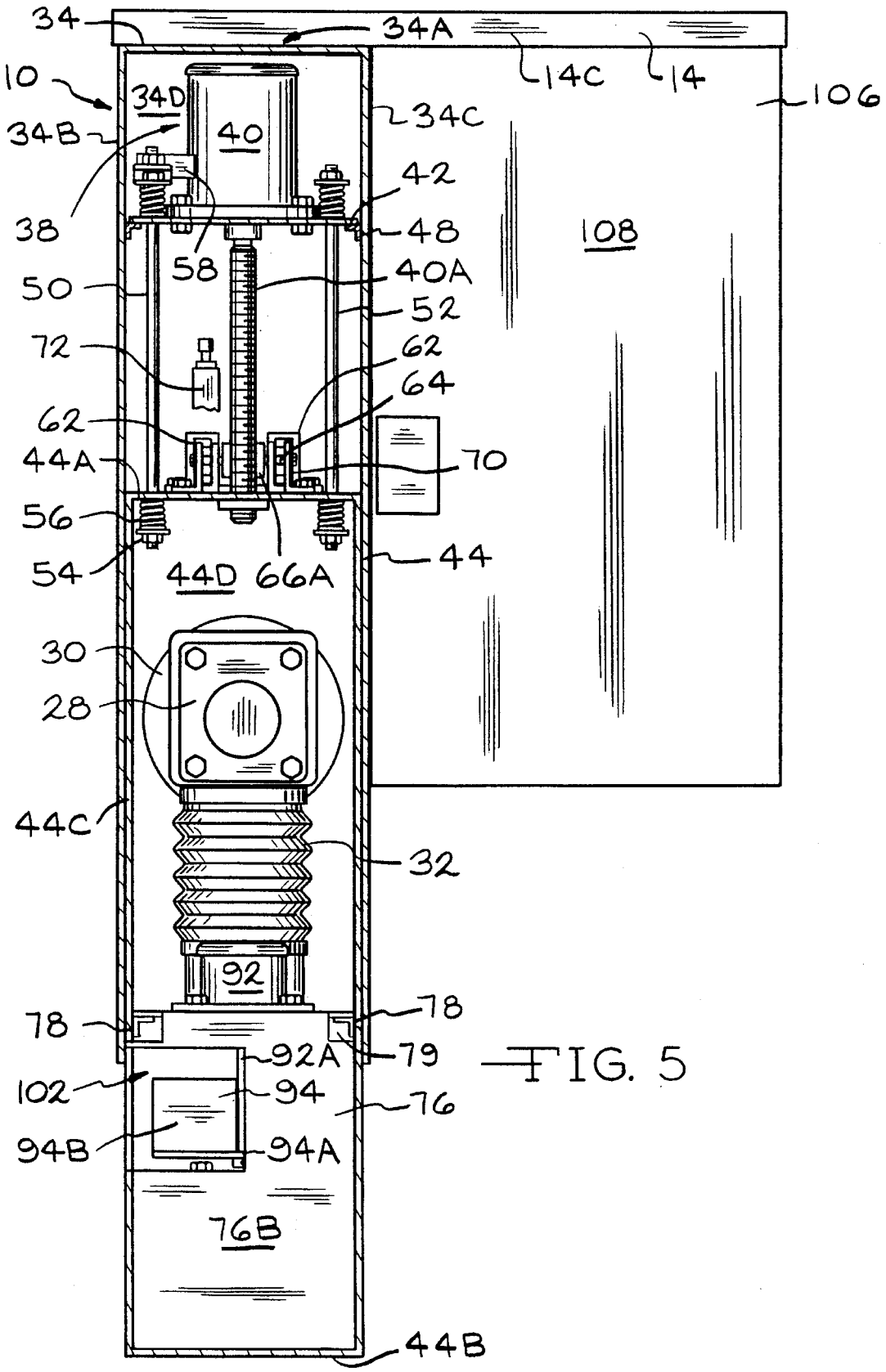
FIG. 5 is a side cross-sectional view of FIG. 4 along the line 5—5 showing the spreader bucket 44 in the lowered position.

In the preferred embodiment, the control box 106 is rectangular in shape with a top wall 106A, a bottom wall 106B with sidewalls 106C and 106D therebetween and a back wall 106E. The front opening of the control box 106 is provided with a door 108 pivotably attached to one of the sidewalls 106C and 106D by hinges (not shown). The control box 106 is mounted on the sidewall 12C of the bin 12 adjacent to the back wall 12B of the bin 12 behind the spreader housing 34. The control box 106 is mounted with the back wall 106E adjacent the sidewall 12C of the bin 12. The top of the back wall 106E of the control box 106 is provided with a lip 106F which allows for mounting the control box 106 on the bin 12 (FIG. 5).

Figure 13:
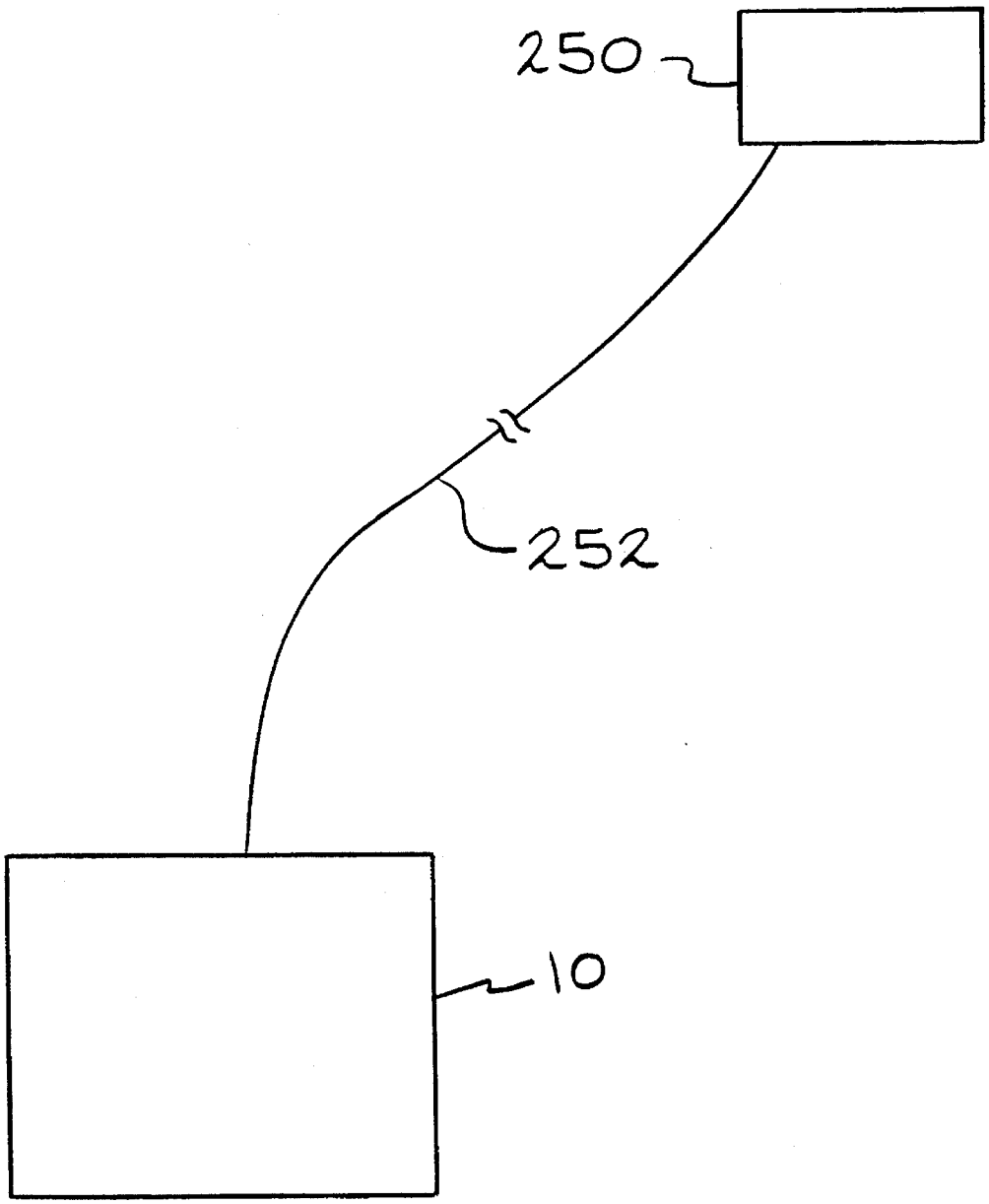
FIG. 13 is a schematic drawing showing control of the spreader 10 from a remote controller location 250.

The control box 106 contains a main control compartment 110 which is mounted to the back wall 106E of the control box 106. The main control compartment 110 is preferably similar to a conventional circuit box. The main control compartment 110 is preferably sealed once all the controls located within the compartment 110 have been installed and programmed. The sealing of the compartment 110 prevents moisture from entering the compartment 110 and potentially damaging the controls. The control box 106 and the compartment 110 are preferably insulated and can be provided with a heating strip (not shown) to prevent the cold from potentially damaging the controls. The control box 106 preferably includes motor controllers 112 for each of the motors 30, 40, 92 and 98, a switch 113 to energize and de-energize the solenoids 62, a timer 114 to deactivate the stationary spreader 10 after a preset duration of operation and a microprocessor 116 for controlling the operation of the entire stationary spreader 10. In addition, an interval clock 117 may be included to ensure a delay between consecutive activations of the spreader 10 regardless of the sensed condition. The microprocessor 116 is preferably mounted within the main control compartment 110 and is programmed before the control box 106 is mounted on the stationary spreader 10. In the preferred embodiment, a sensor 118 is mounted in the ground surface or road surface 202 adjacent the stationary spreader 10 and is connected to a thermostat 120 which is mounted in the control box 106 (FIG. 2). The thermostat 120 determines when the sensor 118 has sensed a temperature of the ground or road surface 202 below a preset minimum which determines when the stationary spreader 10 will be activated. Alternately, the sensor 118 is mounted in the ground surface 202 and detects other conditions, such as moisture level, of the adjacent surface 202 or area to be treated. The sensor 118 sends a signal to an analyzer (not shown) to determine the significance of the sensed condition and the activation of the spreader 10 is based on the sensing of a predetermined condition. In addition, the signal from the sensor 118 can also be remotely read and the stationary spreader 10 can be remotely activated by a user (FIG. 13). In this instance, the spreader 10 can be connected to a remote controller location 250 such as by cables 252 which could be the existing conventional telephone lines. It is also possible that the spreader 10 could be controlled remotely without the need for a physical connection such as using radio waves. The spreader 10 can also be programmed to automatically activate after timed intervals regardless of a sensed condition. The various controls in the control box 106 are preferably connected to the motors 30, 40, 92 and 98 and the solenoids 62 by pin connectors 122 (one shown) which allow for easy connecting and disconnecting of the control circuitry from the remainder of the stationary spreader 10.

The control box 106 can also be provided with a power source such as a battery 124 for operating the spreader 10. Alternately, the power source can be located remotely from the spreader 10 and connected to the spreader 10 by cables (not shown). In addition, the spreader 10 can be powered by outside existing electrical power lines (not shown).

In an alternate embodiment (not shown), a second liquid spreader can be provided adjacent the spreader 10. The liquid spreader has a separate storage container for the liquid material and also has a separate spreader system. The spreader system of the liquid spreader is mounted along the bottom of the barrier 200 on the side adjacent the road surface 202. The spreading system includes a tubular conduit having a plurality of sprinkler outlets along its length. The outlets allow for complete coverage of the road surface 202 adjacent the barrier 200. The liquid spreader would be controlled by the control box 106 and could be activated simultaneously or alternately with the spreader 10.

IN USE

The stationary spreader 10 is mounted on the top of a barrier 200 adjacent the surface 202 to be treated. However, the stationary spreader 10 can also be free standing. In the preferred embodiment, the stationary spreader 10 is permanently mounted adjacent a road surface 202 such that the front wall 34B of the spreader housing 34 faces the road surface 202. The sensor 118 is mounted in the ground surface or road surface 202 adjacent the stationary spreader 10. The sensor 118 is mounted such as to prevent tampering or accidental damage. Once the stationary spreader 10 is permanently mounted, the bin 12 is preferably filled with a material such as salt. The term "salt" as used herein includes salt granules or salt solutions in water or other solvents. The salts can be sodium chloride, potassium chloride, calcium chloride and other materials, such as materials used to treat a road surface 202. Alternately, when the stationary spreader 10 is mounted in a growing area, some other material such as a fertilizer in a solid or liquid state can be used to fill the bin 12. Preferably, the salt or other material is moved into the bin 12 through the opening 14A in the lid 14. In the preferred embodiment, a supply truck (not shown) is moved into position adjacent the stationary spreader 10. The truck has a supply chute which is moved into contact with the door 14B of the lid 14 of the bin 12. The chute holds the door 14B open while the bin 12 is being filled. This allows the stationary spreader 10 to be easily filled without having to unlock the door 14B of the bin 12.

Figure 12:
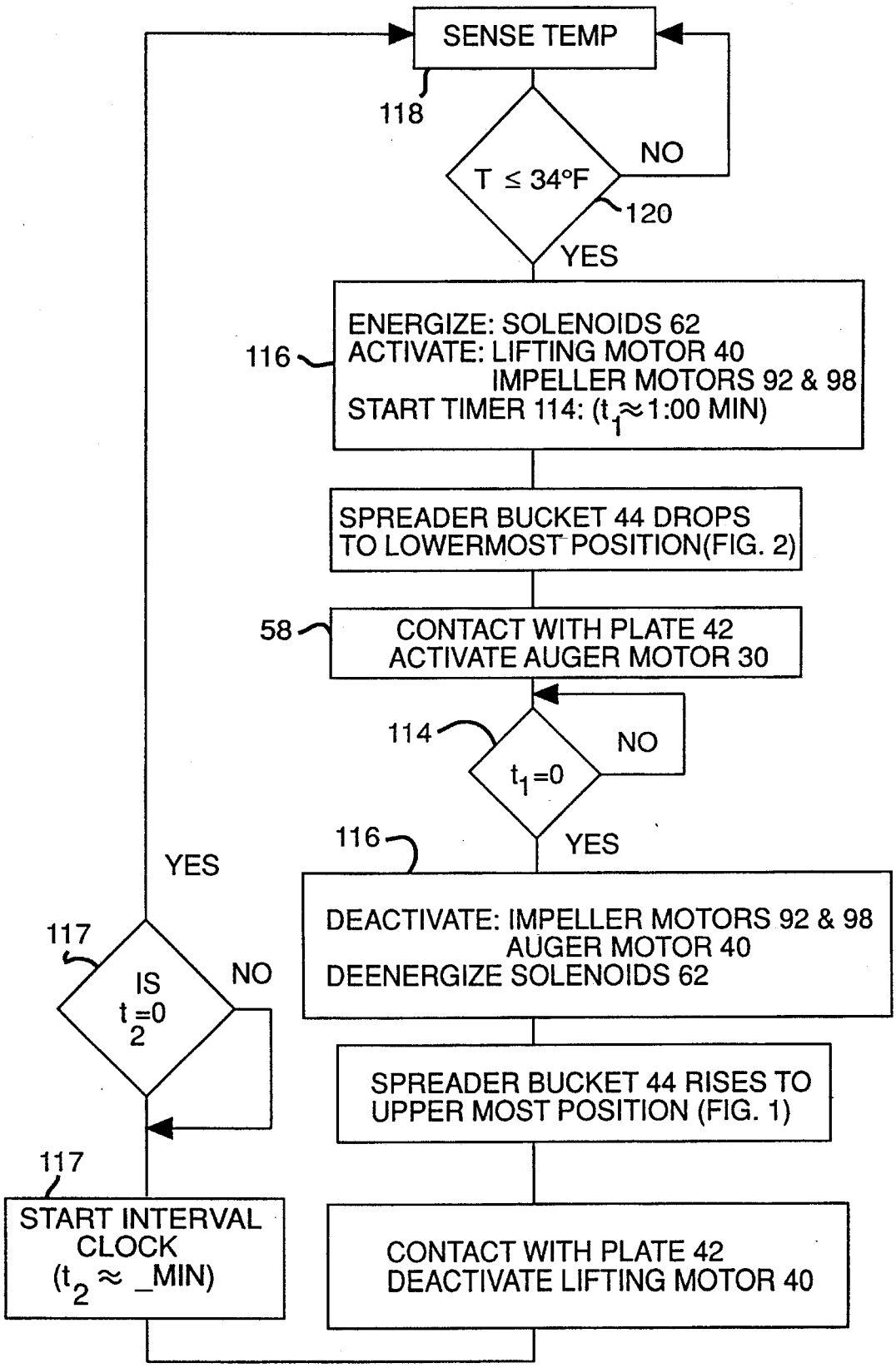
FIG. 12 is a flow chart showing the steps of the operation of the stationary spreader 10.

Once all the controls have been set, the control compartment 110 is closed and sealed and the control box 106 is closed and locked. Preferably, the controls are set for automatic activation, alternately, the controls can be monitored and controlled from a remote location such as by a computer link up once the controls have been sealed and locked in the control box 106 and the control box 106 has been mounted on the bin 12. FIG. 12 shows the operational steps of the stationary spreader 10 of the preferred embodiment. In the preferred embodiment, prior to mounting, the microprocessor 116 is programmed to activate the stationary spreader 10 when the ground surface or road surface 202 reaches a preset minimum temperature as sensed by the sensor 118 and as determined by the thermostat 120. When the temperature of the road surface 202 or ground surface containing the sensor 118 reaches the preset minimum temperature, the sensor 118 senses the temperature and the thermostat 120 reads the temperature and sends the signal to the microprocessor 116. Alternately, if the spreader 10 is being controlled from a remote controller location 250, the user would determine when the spreader 10 is to be activated (FIG. 13). In the preferred embodiment, the preset minimum temperature (T) is below about 34° F. and preferably above −30° F. (FIG. 12). Alternately, the sensor 118 detects other conditions and sends a signal to the analyzer which then compares the detected condition to a preset condition and sends a signal to the microprocessor 116 which activates the stationary spreader 10 when necessary. When a condition requiring activation is sensed, the microprocessor 116 first activates the lifting motor 40 and the impeller motors 92 and 98 simultaneously. In the alternate embodiment, the oscillating motor 244 would be activated simultaneously with the lifting motor 40. In both embodiments, the microprocessor 116, at the same time, also energizes the solenoids 62 which pull back the shaft 66 and threaded holder 66A from around the rotating threaded shaft 40A of the lifting motor 40. When the holder 66A is removed from the threaded shaft 40A, the spreader bucket 44 is no longer being held up and thus, the bucket 44 free falls downward due to gravity. The free fall of the bucket 44 allows the bottom wall 44B of the bucket 44 to make forceful contact with any snow or other debris that may be located beneath the spreader bucket 44 thus, packing down the snow and allowing the bucket 44 to extend to its fully lowered position. The springs 56 located adjacent the nuts 54 on the connector rods 50 and 52, cushions the top of the bucket 44 after free fall thus, preventing damage to the bucket 44 or the plate 42. In the preferred embodiment, the length of the rotating shaft 40A of the lifting motor 40 and the length of the connector rods 50 and 52 are adjustable such that the distance the bucket 44 drops is adjustable. Preferably, the bucket 44 drops approximately between about 8 and 24 inches (20 to 61 cm) in order to allow the stationary spreader 10 to be mounted at different distances above the surface 202 to be treated. When the bucket 44 reaches its fully lowered position, the first switch 58 on the end 50A of one of the connector rods 50 comes in contact with the plate 42 which turns the first switch 58 "on" and in turn activates the auger motor 30 (FIG. 4). Thus, the auger 18 and stirrer 16 do not begin moving the material out of the bin 12 and into the spreaders 86 and 88 until the spreaders 86 and 88 are in the fully lowered position. This also acts as a safety system. If the spreader bucket 44 is unable to be fully lowered such as due to an obstruction beneath the bucket 44, the auger motor 30 will not be activated and thus, material will not be supplied to the spreaders 86 and 88. In the alternate embodiment, the first switch 58 activates the pump 220 and the electronic valve 228 in order to move the material into the nozzles 232 and 234. Preferably, the openings 102 and 104 of the bucket 44 and the spreader compartment 76 are completely below the spreader housing 34, when the spreader is in the lowermost position.

Figure 6:
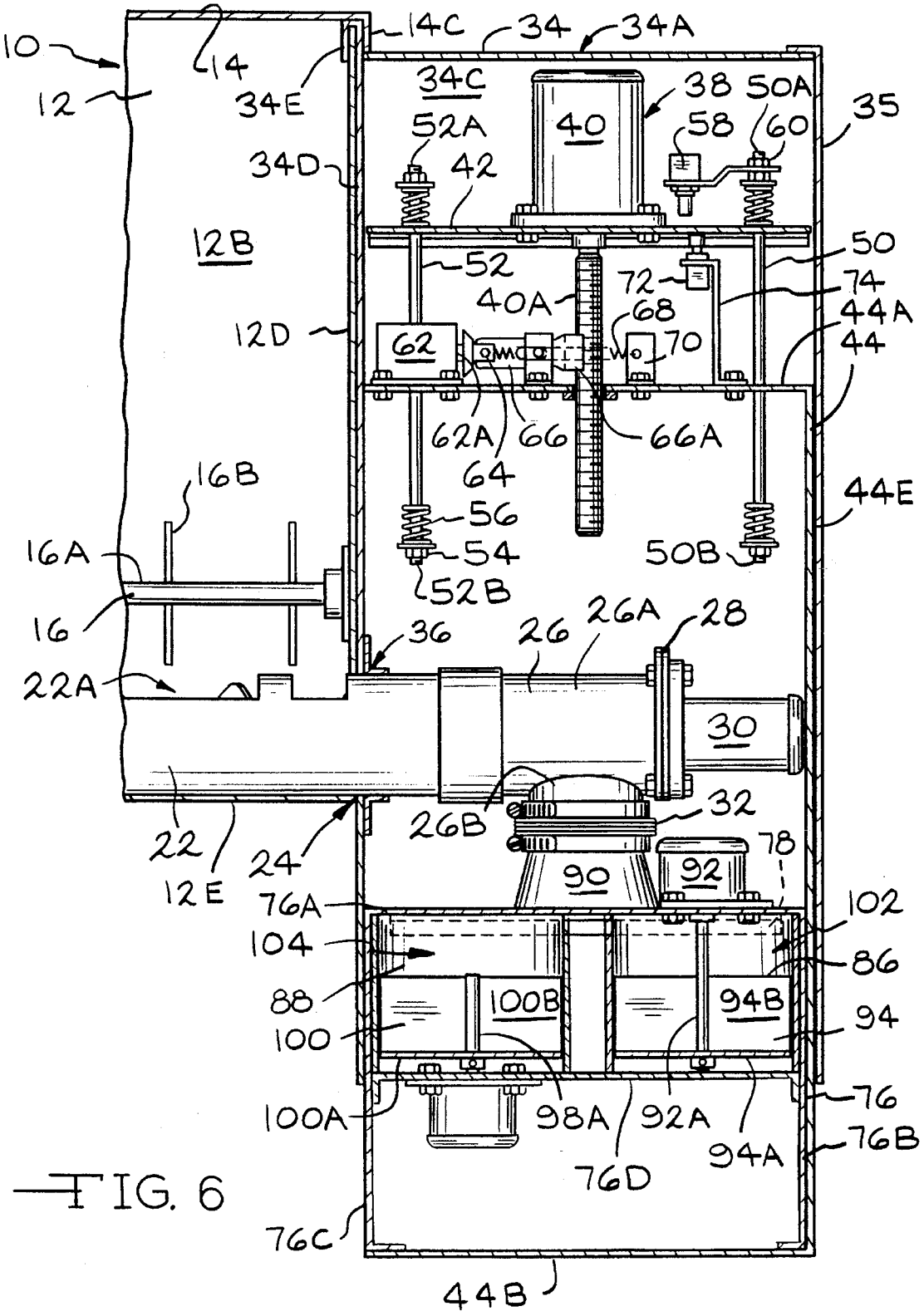
FIG. 6 is a partial front cross-sectional view of the stationary spreader 10 with the spreader bucket 44 in the raised, unactivated position.
Figure 7:
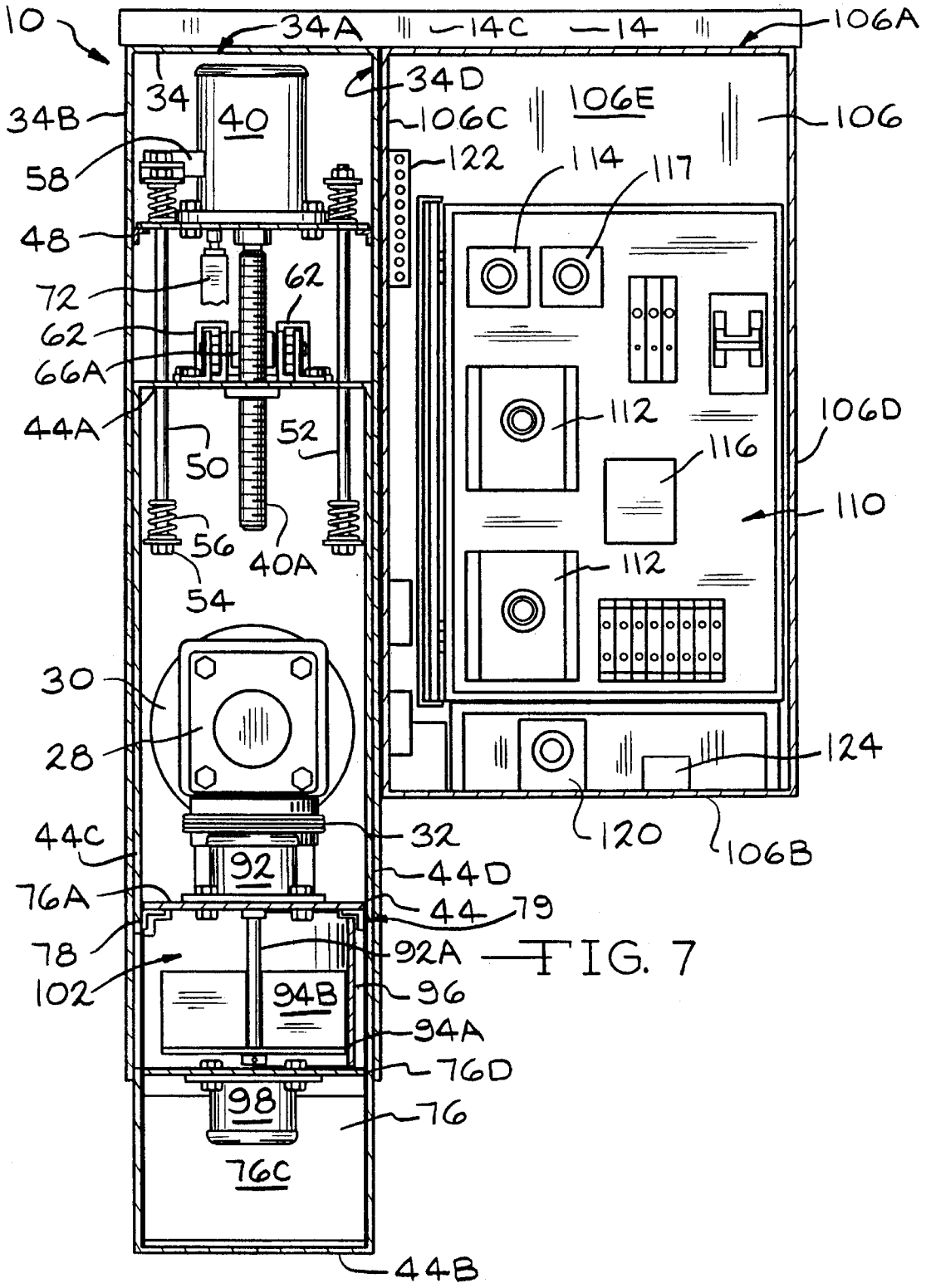
FIG. 7 is a side cross-sectional view of the stationary spreader 10 with the spreader bucket 44 in the raised unactivated position showing the timer 114 and the motor controls 112.

Once the stationary spreader 10 is activated, the timer 114 begins running. After a preset duration of operation (t), the timer 114 signals the microprocessor 116 to deactivate the auger motor 30 and the impeller motors 92 and 98 or alternately, the pump 220, the electronic valve 228 and the oscillating motor 224. The microprocessor 116 also simultaneously de-energizes the solenoids 62 which causes the shaft 66 and holder 66A to be released which allows the springs 56 to bias the holder 66A into contact with the rotating threaded shaft 40A of the lifting motor 40. The holder 66A is loosely in contact with the threaded shaft 40A until the threads of the holder 66A match and engage the threads of the shaft 40A at which time the holder 66A moves up the shaft 40A and lifts the spreader bucket 44 upward. Once the bucket 44 reaches its uppermost, lifted position, the second switch 72 mounted above the top of the bucket 44 comes in contact with the plate 42 which deactivates the lifting motor 40 (FIGS. 6 and 7). In the raised, uppermost position, only the bottom of the bucket 44 below the inner middle shelf 76D of the spreader compartment 76 extends below the spreader housing 34. In the preferred embodiment, the stationary spreader 10 operates for a period of approximately about $t_1$=0.5 to 3.0 minutes before being deactivated. Once the stationary spreader 10 has been deactivated, the interval clock 117 begins to count down from the preset delay interval ($t_2$). The preset delay interval ($t_2$) is preferably between about 6 and 8 hours thus, the stationary spreader 10 preferably remains unactivated at least between about 6 to 8 hours between each activation regardless of the temperature or other sensed condition of the adjacent ground or road surface 202. Thus, the spreader 10 will not run continuously if the temperature of the adjacent road surface 202 remains below the preset minimum temperature or a sensed condition remains. In the preferred embodiment, the stationary spreader 10 is also provided with a counter (not shown) which counts the number of times the stationary spreader 10 is activated thus, allowing the user to estimate when the bin 12 needs to be refilled. In the preferred embodiment, the spreaders 86 and 88 spread the material about 50 feet (1524 cm) on either side of the spreaders 86 and 88 and a distance of approximately between about 50 feet (1524 cm) in front of the spreader housing 34.

The stationary spreader 10 may also be provided with an electric eye (not shown) adjacent the spreaders 86 and 88 to determine whether or not the lowering of the spreader bucket 44 is blocked. The stationary spreader 10 may also be provided with a camera (not shown) which will view the spreaders 86 and 88 and the surrounding area so that a remote operator can determine whether or not the spreaders 86 and 88 are working correctly.

Numerous variations will occur to those skilled in the art. It is intended therefore that the foregoing description be only illustrative of the present invention and that the present invention be limited only by the hereinafter appended claims.

I claim:

1. A stationary spreader apparatus to be located adjacent a ground surface for spreading a material on the ground surface to treat the ground surface, which comprises:

(a) a storage container having at least one opening for dispensing the material;

(b) a vertically movable spreader means having an inlet connected to the opening in the storage container and having an outlet for spreading the material including;

(i) a movement means connected to the spreader means for moving the spreader means in a vertical direction toward and away from the ground surface;

(ii) a dispensing means mounted between the inlet and the outlet of the spreader means for moving the material through the outlet; and (c) a control means connected to the movement means and the dispensing means for activating the movement means to move the spreader means in a vertical direction toward the ground surface and for activating the dispensing means to dispense the material on the ground surface.

2. The apparatus of claim 1 wherein the material is fertilizer.

3. The apparatus of claim 1 wherein the material is in a liquid state.

4. The apparatus of claim 1 wherein the ground surface is a road surface.

5. The apparatus of claim 1 wherein the movement means is activated in response to the control means sensing a temperature below a preset minimum temperature.

6. The apparatus of claim 1 wherein the power supply is connected to the control means and provides power for the spreader apparatus.

7. The apparatus of claim 1 wherein a semicircular conduit is provided around a bottom of an auger means and adjacent the opening of the storage container for directing the material toward the opening of the storage container.

8. The apparatus of claim 1 wherein a supply conduit extends between the opening of the storage container and the inlet of the spreader means to provide a passageway from the storage container to the spreader means and includes an expandable portion to allow for vertical movement of the spreader means toward and away from the opening.

9. The apparatus of claim 1 wherein the spreader means is slidably mounted in a spreader housing removably mounted on a side of the storage container.

10. The apparatus of claim 1 wherein the movement means includes a pair of solenoids and a lifting motor with a threaded shaft.

11. The apparatus of claim 10 wherein the lifting motor is mounted on a plate of the spreader means and is slidably connected to a bucket supporting the solenoids and the dispensing means.

12. The apparatus of claim 11 wherein a first switch mounted adjacent the lifting motor and comes in contact with the plate to activate the auger motor when the bucket is in the lowermost position.

13. The apparatus of claim 11 wherein a shaft is connected to the solenoids and is provided with a threaded holder perpendicular to the threaded shaft of the lifting motor.

14. The apparatus of claim 13 wherein the solenoids are energized by the control means to pull the threaded holder away from the threaded shaft of the lifting motor to enable the spreader means to move toward the ground surface.

15. The apparatus of claim 13 wherein the solenoids are de-energized by the control means to move the threaded holder into contact with the threaded rod of the lifting motor to move the spreader means away from the ground surface into the spreader housing after a predetermined time of operation.

16. The apparatus of claim 1 wherein the dispensing means is an impeller means mounted inside the spreader means below the inlet and adjacent the outlet and wherein the impeller means rotates around a longitudinal axis of the spreader means.

17. The apparatus of claim 16 wherein the impeller means is mounted on a shaft of a motor means and wherein the motor means rotates the impeller means around the longitudinal axis of the spreader means for spreading the material on the ground surface.

18. The apparatus of claim 1 wherein the spreader means includes two inlets and two outlets with two dispensing means between the inlets and the outlets for spreading the material.

19. The apparatus of claim 18 wherein the two dispensing means are mounted horizontally side-by-side.

20. The apparatus of claim 19 wherein the two dispensing means rotate in opposite directions so as to increase an area of ground surface covered by the material.

21. The apparatus of claim 1 wherein the spreader apparatus is mounted onto a top side of a barrier for spreading material onto the ground surface adjacent the barrier.

22. The apparatus of claim 1 wherein the control means includes a microprocessor.

23. The apparatus of claim 1 wherein the control means includes a sensor for sensing a condition, a timer for measuring the duration of operation of the apparatus and controls for activating or deactivating the dispensing means and raising or lowering the spreader means in response to signals from the sensor and the timer.

24. The apparatus of claim 23 wherein the sensor means extends into the ground surface adjacent the spreader apparatus to detect the conditions of the ground surface.

25. The apparatus of claim 23 wherein the controls activate the dispensing means and lower the spreader means in response to a signal from the sensor indicating the occurrence of a predetermined condition.

26. The apparatus of claim 1 wherein the spreader means moves vertically toward the ground surface due to gravity.

27. The apparatus of claim 1 wherein the control means is controlled and monitored from a remote station.

28. The apparatus of claim 1 wherein the control means is mounted in a control box removably mounted on a side of the storage container adjacent the spreader means.

29. The apparatus of claim 1 wherein the dispensing means is a nozzle.

30. The apparatus of claim 1 wherein the dispensing means is a pair of nozzles mounted horizontally side-by-side.

31. The apparatus of claim 30 wherein a pump is mounted adjacent to the opening of the storage container for moving a liquid material to the nozzles.

32. The apparatus of claim 30 wherein an oscillating motor is connected to the pair of nozzles to rotate the nozzles simultaneously.

33. The apparatus of claim 32 wherein the nozzles are rotated between 0° and 180°.

34. A stationary salt spreader apparatus to be located adjacent a road surface for spreading salt on the road surface to melt ice and snow on the road surface, which comprises:

(a) a storage container having at least one opening for dispensing the salt;

(b) a vertically movable spreader means having an inlet connected to the opening in the storage container and having an outlet for spreading the salt including;

(i) a movement means connected to the spreader means for moving the spreader means in a vertical direction toward and away from the road surface;

(ii) an acceleration means mounted between the inlet and the outlet of the spreader means for moving the salt through the outlet;

(iii) a motor means connected to the acceleration means for moving the acceleration means; and (c) a control means connected to the movement means and the motor means for activating the movement means to move the spreader means in a vertical direction toward the road surface and for activating the motor means to move the acceleration means to dispense the salt on the road surface.

35. The apparatus of claim 34 wherein the control means includes a microprocessor.

36. The apparatus of claim 34 wherein the control means includes a counter means which counts the amount of times the apparatus is activated.

37. The apparatus of claim 34 wherein the salt spreader apparatus has a power supply which is connected to the control means and which provides power for the salt spreader apparatus.

38. The apparatus of claim 34 wherein a stirring means is mounted inside the storage container for loosening the salt for easier movement of the salt through the opening of the storage container.

39. The apparatus of claim 38 wherein an auger means is mounted inside the storage container and an auger motor is mounted outside of the storage container and is mounted on an end of the auger means for rotating the auger means for moving salt toward the opening of the storage container.

40. The apparatus of claim 39 wherein the stirrer means and the auger means are connected together for simultaneous movement.

41. The apparatus of claim 39 wherein a semicircular conduit is provided around a bottom of the auger means and adjacent the opening of the storage container for directing the salt toward the opening of the storage container.

42. The apparatus of claim 34 wherein a supply conduit extends between the opening of the storage container and the inlet of the spreader means to provide a passageway from the storage container to the spreader means and includes an expandable portion to allow for vertical movement of the spreader means toward and away from the opening.

43. The apparatus of claim 34 wherein the spreader means is slidably mounted in a spreader housing removably mounted on a side of the storage container.

44. The apparatus of claim 43 wherein the movement means includes a pair of solenoids and a lifting motor with a threaded shaft.

45. The apparatus of claim 44 wherein the lifting motor is mounted on a plate of the spreader means and is slidably connected to a bucket supporting the solenoids, the acceleration means and the motor means.

46. The apparatus of claim 45 wherein a first switch is mounted adjacent the lifting motor and comes in contact with the plate to activate the auger motor when the bucket is in the lowermost position.

47. The apparatus of claim 45 wherein a second switch is mounted on the bucket adjacent the solenoids and comes in contact with the plate to deactivate the lifting motor when the bucket is in the uppermost position.

48. The apparatus of claim 45 wherein a shaft is connected to the solenoids and is provided with a threaded holder perpendicular to the threaded shaft of the lifting motor.

49. The apparatus of claim 48 wherein the solenoids are energized by the control means to pull the threaded holder away from the threaded shaft of the lifting motor to enable the spreader means to move toward the road surface when the control means senses a temperature below a preset minimum temperature.

50. The apparatus of claim 48 wherein the solenoids are de-energized by the control means to move the threaded holder into contact with the threaded rod of the lifting motor to move the spreader means away from the road surface into the spreader housing after a predetermined time of operation.

51. The apparatus of claim 34 wherein the movement means is activated in response to the control means sensing a temperature below a preset minimum temperature.

52. The apparatus of claim 34 wherein the accelerator means is an impeller means mounted inside the spreader means below the inlet and adjacent the outlet and wherein the impeller means rotates around a longitudinal axis of the spreader means.

53. The apparatus of claim 52 wherein the impeller means is mounted on a shaft of the motor means and wherein the motor means rotates the impeller means around the longitudinal axis of the spreader means for spreading salt on the road surface.

54. The apparatus of claim 34 wherein the spreader means includes two inlets and two outlets with two acceleration means and two motor means between the inlets and the outlets for spreading the salt.

55. The apparatus of claim 54 wherein the two acceleration means are mounted horizontally side-by-side.

56. The apparatus of claim 55 wherein the two acceleration means rotate in opposite directions so as to increase an area of road surface covered by the salt.

57. The apparatus of claim 35 wherein the salt spreader apparatus is mounted onto a top side of a barrier for spreading salt onto the road surface adjacent the barrier.

58. The apparatus of claim 35 wherein the control means includes a sensor for sensing a temperature of a road surface, a timer for measuring the duration of operation of the apparatus and controls for activating or deactivating the motors and raising and lowering the spreader means in response to signals from the sensor and the timer.

59. The apparatus of claim 58 wherein the sensor means extends into the ground surface adjacent the salt spreader apparatus to detect the temperature of the ground surface.

60. The apparatus of claim 59 wherein the sensor means adjacent the salt spreader apparatus detects the temperature of concrete adjacent the salt spreader apparatus.

61. The apparatus of claim 60 wherein the controls activate the motors and raise the spreader means in response to a signal from the sensor indicating a temperature below a preset minimum temperature.

62. The apparatus of claim 61 wherein the preset minimum temperature is between about −30° and 34° F.

63. The apparatus of claim 61 wherein the timer means deactivates the salt spreader apparatus after less than about 1 minute operation.

64. The apparatus of claim 35 wherein the control means is controlled and monitored from a remote station.

65. A method for treating a ground surface with a stationary spreader apparatus adjacent the ground surface for spreading a material on the ground surface to treat the ground surface which comprises: a storage container having at least one opening for dispensing the material; a vertically movable spreader means having an inlet connected to the opening in the storage container and having an outlet for spreading the material including; a movement means connected to the spreader means for moving the spreader means in a vertical direction toward and away from the ground surface; a dispensing means mounted between the inlet and the outlet of the spreader means for moving the material through the outlet; and a control means connected to the movement means and the dispensing means for activating the movement means to move the spreader means in a vertical direction toward the ground surface and for activating the dispensing means to dispense the material on the ground surface;

(a) filling the storage container with the material; and (b) signalling the control means to activate the movement means and the dispensing means for dispensing the material on the ground surface to treat the ground surface.

66. A method for melting ice and snow accumulated on a road surface with a stationary spreader apparatus adjacent the road surface for spreading salt on the road surface to melt ice and snow on the road surface, which comprises: a storage container having at least one opening for dispensing the salt; a vertically movable spreader means having an inlet connected to the opening in the storage container and having an outlet for spreading the salt including a movement means connected to the spreader means for moving the spreader means in a vertical direction toward and away from the road surface an acceleration means mounted between the inlet and the outlet of the spreader means for moving the salt through the outlet and a motor means connected to the acceleration means for moving the acceleration means; and a control means connected to the movement means and the motor means for activating the movement means to move the spreader means in a vertical direction toward the road surface and for activating the motor means to move the acceleration means to dispense the salt on the road surface;

(a) filling the storage container with granulated salt; and (b) dispensing the granulated salt from the spreader means by activating the movement means and the motor means in response to the sensing of an ambient temperature below a preset minimum temperature by the control means so that the salt spreader apparatus spreads salt on the road surface to melt the ice and snow.

* * * * *